United States Patent [19]

Lapointe

[11] 4,405,854

[45] Sep. 20, 1983

[54] COMBINED DENTURE MOLD DEWAXER AND CURING BASIN

[76] Inventor: Denis Lapointe, rue de la Colline - P.O. Box 128, St. Jovite, Canada, J0T 2H0

[21] Appl. No.: 389,985

[22] Filed: Jun. 18, 1982

[51] Int. Cl.[3] ..... F27B 14/00

[52] U.S. Cl. ..... 219/421; 134/106; 134/108; 219/331; 219/425; 219/437; 219/521; 264/17; 264/344; 264/233; 425/176; 425/446

[58] Field of Search ..... 219/310, 315, 331, 400, 219/401, 420, 390, 421-424, 425, 426, 437, 521, 523; 134/106, 108; 164/344; 264/17, 46.8, 234, 233, 319, 309, 344; 255/309; 425/175, 446

[56] References Cited

U.S. PATENT DOCUMENTS

| | | | |
|---|---|---|---|
| 2,360,986 | 10/1944 | Taub | 425/446 |
| 2,498,368 | 2/1950 | Harrison | 264/17 |
| 3,061,898 | 11/1962 | Makiszewski | 219/310 X |
| 3,190,944 | 6/1965 | Moore | 264/46.8 |
| 3,404,056 | 10/1968 | Baldwin | 264/17 X |
| 3,415,922 | 12/1968 | Carter et al. | 264/344 X |
| 3,493,037 | 2/1970 | Haake | 219/331 X |
| 3,792,801 | 2/1974 | Baker et al. | 219/425 X |
| 3,869,595 | 3/1975 | Collins et al. | 219/521 X |
| 4,107,359 | 8/1978 | Witt et al. | 219/521 X |
| 4,370,130 | 1/1983 | Berger | 219/421 X |

*Primary Examiner*—Volodymyr Y. Mayewsky

[57] ABSTRACT

A basin for simultaneous or consecutive dewaxing and curing of denture molds is disclosed. The basin is generally box-shaped and is provided with three vertically-shaped trays of which the topmost remains above the high fluid level. The upper rear portion of the basin has a pivotally-secured frame-arm provided with a plurality of nozzles adapted to spray over the entire area of the topmost tray. The fluid from the nozzles drains back into the basin; a recirculating pump recirculates the fluid back into the nozzles. A separate fluid inlet is provided to fill the basin for curing. The basin is further provided with an upper and lower fluid level-limiting means, a heating element, a thermostat and, preferably, an automatic timer.

8 Claims, 8 Drawing Figures

COMBINED DENTURE MOLD DEWAXER AND CURING BASIN

FIELD OF THE INVENTION

The present invention relates to an improved apparatus for denture fabrication, more specifically to a basin adapted to remove wax from and cure denture molds in the same basin.

BACKGROUND OF THE INVENTION

As is well known in the art, the preparation of dentures involves the following steps:

(a) imprints of the gums of a subject are made with agar or suitable material (called the "negative");

(b) a model of each "negative" is made in plaster (called the "positive");

(c) the model is placed in the lower half of a flask and a surrounding parting surface is provided;

(d) the model is covered with a thin layer of wax into which a set of teeth is embedded;

(e) the upper half of the flask is added and filled with plaster, which, when set, holds the teeth in position;

(f) the wax is removed and the denture material is introduced;

(g) the denture material, usually a resin-type plastic, is cured.

Till now the last two steps were done in separate operations. For example, the removal of wax is usually carried out in an ordinary sink under the hot water faucet, thus creating the problem of wax accumulating in the drain and plugging the same when the wax hardens. To overcome this disadvantage, U.S. Pat. No. 3,061,898 to Maliszewski discloses a basin which incorporates a hand-held hose and nozzle. The latter is either directed into the basin containing the flasks to be dewaxed or over the top of the basin where the flasks are held by tongs with the other hand. This can be dangerous as the flasks are usually cleaned of wax by water close to or at the boiling point.

Two other U.S. patents describe a process and apparatus directed to cure the denture material properly: U.S. Pat. Nos. 2,498,368 and 2,360,986 to Harrison and Taub, respectively. However, neither of these patents disclosed a basin wherein both the dewaxing and curing steps can be carried out simultaneously or consecutively; the first Patent being a process and the second Patent being an apparatus adapted to cure a flask by placing a heating element inside the latter.

OBJECTS OF THE INVENTION

In view of the above, it is an important object of this invention to provide a basin conceived to both dewax and cure a denture mold in simultaneous or consecutive steps.

It is another object of this invention to provide a basin provided with specially-formed spray means to carry out the dewaxing of denture molds.

It is yet another object of the invention to provide a basin adapted to contain a curing fluid, means to heat the fluid to a desired temperature and support means for the denture molds.

It is still another object of the present invention to provide a basin of the above type, which is simple in design and inexpensive to manufacture.

SUMMARY OF THE INVENTION

The above and other objects and advantages of the invention are realized according to a preferred embodiment comprising a basin having side walls, a rear wall, a front wall and a bottom floor wall as well as, preferably, an anti-vapor cover. The basin is adapted to be filled to predetermined levels with fluid (usually water).

The interior space of the basin is provided with a first topmost tray which extends horizontally from end wall to end wall of the basin. Support means are provided for the tray and the latter always remains above the fluid level in the basin.

Second and third trays are also provided in the basin, being downwardly spaced from the first tray and also vertically spaced from each other. Support means are provided for the second and third trays.

All three trays are perforated in thin bottoms and sides with a plurality of holes, allowing the fluid in the basin to circulate freely therethrough.

Dewaxing of the denture molds is achieved by firstly placing the flasks in the basin, immersed, until the wax is hot enough to permit separation of the flask halves; and, secondly, by placing the separated flask halves in the first tray. To finish the dewaxing process, a frame-arm extending across the top of the basin is pivotally secured to the basin adjacent the upper rear edge thereof. This frame-arm is provided with spaced-apart shower nozzles, as many as needed to spray over the entire area of the topmost tray. The arm is adapted to pivot from a horizontal position overlying the topmost tray to a substantially vertical position to allow easy access to the topmost tray.

Pump means are provided to continuously circulate the fluid back into the shower nozzles after it has drained into the basin.

Switch means are also provided to deactivate the pump when the arm is pivoted to the vertical position, thereby shutting off the water supply to the nozzles.

It will be readily understood that the dewaxing operation is carried out by placing the half-flasks in the topmost tray and pivoting the arm downwardly into horizontal spray position until the last vestiges of wax are removed from the flasks. Then the latter are ready for the final curing step.

To accomplish the latter, the half-flasks are closed together and placed in the lower second tray, or third tray. Then the basin is filled to a predetermined level with fluid, such that the flasks are completely immersed in the fluid. The latter is heated to a desired curing temperature by heating means. The curing temperature is maintained at a constant degree by a thermostat. Preferably, an automatic timer is also provided to deactivate the heating means after the necessary curing time.

It is to be noted that the heating means remains at all times submerged in the fluid to prevent burning-out. Therefore, preferably, an automatic fluid level regulating means is provided in the basin to regulate the upper and lower fluid levels in the basin, the lower level being just above the heating means and, when the basin is filled, the upper level being just under the topmost tray.

A valve separate from the circulating pump is provided to fill the basin for curing. It is connected to a fluid supply source.

BRIEF DESCRIPTION OF THE DRAWINGS

The above will be more clearly understood by having referral to the preferred embodiment of the invention, illustrated by way of the accompanying drawings, in which.

Like numerals refer to like elements throughout the drawings.

DETAILED DESCRIPTION OF THE PREFERRED EMBODIMENT

Figure 2:
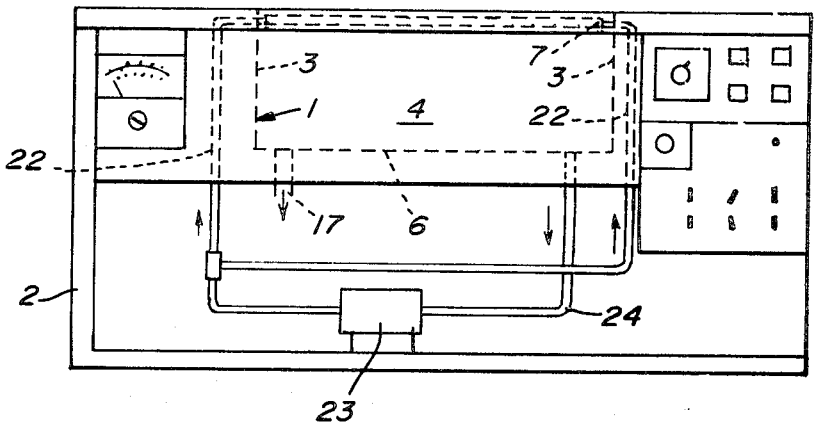
FIG. 2 is a front elevation of the invention showing the basin proper in dashed outline.
Figure 1:
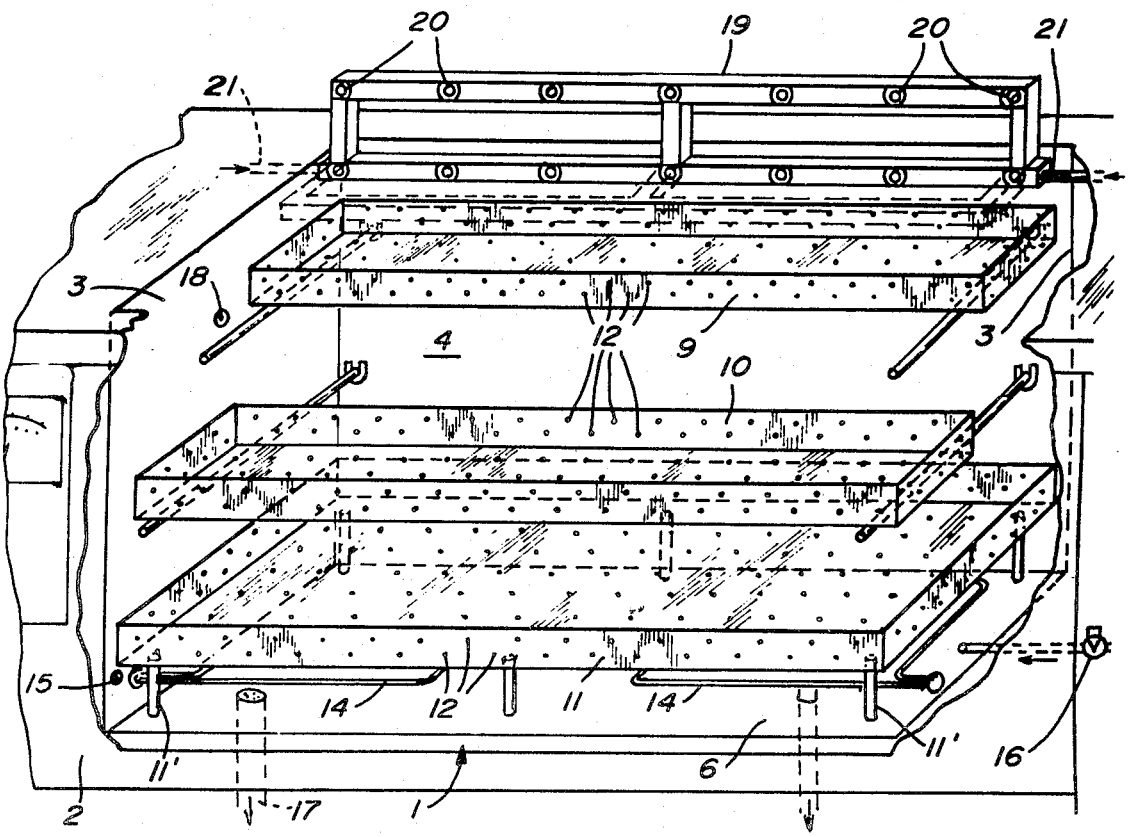
FIG. 1 is a perspective view of the basin with the front wall broken away to show the interior of the basin, also showing the frame-arm in vertical position.

The preferred embodiment of the invention comprises a basin 1 mounted in a suitable box-like frame 2, as suggested in FIGS. 1 and 2. Basin 1 has a pair of opposite end walls 3, a rear wall 4, a front wall 5, a floor 6 and, preferably, an anti-vapor cover 7 (seen only in FIG. 2). Basin 1 is adapted to be filled with fluid 8 (usually hot water).

The interior space of basin 1 is occupied by three vertically-spaced trays: a topmost tray 9, a middle tray 10 and a third lowermost tray 11. All three trays are perforated with a plurality of holes 12 to allow fluid 8 to circulate freely therethrough. Preferably, topmost tray 9 and middle tray 10 are of a substantially lesser width than the width of basin 1 and are slidably mounted for transverse movement on guideways 13. This is to facilitate access to the lowermost tray 11. The latter is preferably supported above the floor 6 of basin 1 by legs 11′ at each of its corners.

An electric heating element 14 is provided to heat the fluid 8. It is located under lowermost tray 11 adjacent floor 6.

It is to be noted that element 14 remains always submerged in the water of basin 1. To ensure that the water level does not fall low enough to expose element 14 (and, thus, risk its burning-out), a water level sensor 15 is provided in one of the end walls 3 (cf. FIG. 1) just above element 14. When the water level falls low enough in basin 1, sensor 15 activates an electric inlet valve 16 which is connected to an external water supply (not shown). Basin 1 is also provided with a drain 17 to empty the water down to the level of sensor 15, as needed.

An upper water level limiting means has also been provided for in-basin 1, consisting of a second sensor 18 located in one of the end walls 3 just under topmost tray 9. When the water level reaches sensor 18, the latter shuts off inlet valve 16 automatically.

The elements of basin 1 further include a frame-arm 19 extending from end to end of basin 1 and pivotally secured thereto adjacent the upper rear edge thereof. Frame-arm 19 is provided with a plurality of shower nozzles 20, which are adapted to spray water over the entire surface of topmost tray 9. Arm 19 is pivotally secured by means of pins 21. These latter are of hallow construction and constitute inlet nipples for the water flowing into arm 19 which, of course, is also hollow.

Each pin 21 is connected by means of feed pipes 22 to a recirculating pump 23 located in frame 2 underneath floor 6 of the basin. A return pipe 24 communicates with the floor 6 of basin 1 at one end and is connected to pump 23 at its other end. Thus, as will be readily understood, the heated water 8 is pumped through shower nozzles 20, which then drains into basin 1 through return pipe 24 and back to pump 23 for recirculation.

Figure 3:
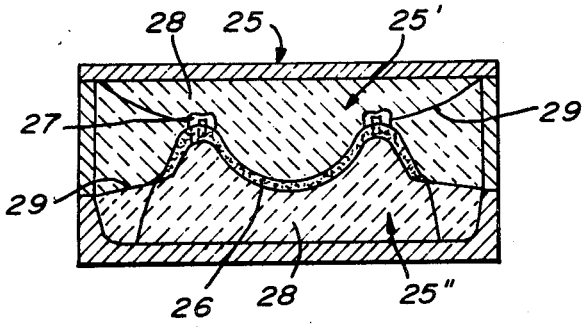
FIG. 3 is a cross-sectional view of two assembled denture flask halves containing a denture model and artificial teeth.
Figure 8:
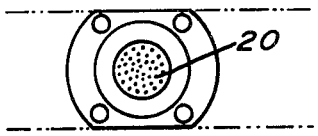
FIG. 8 is a bottom view of the shower nozzle of FIG. 7.
Figure 7:
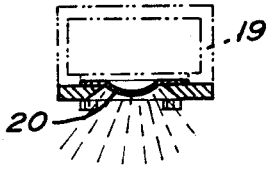
FIG. 7 is a cross-sectional side view of one of the shower nozzles.

Referring now to FIG. 3, there is shown a denture mold flask 25, made of suitable rigid material, as commonly used in the art. Flask 25 is made in two halves 25′ and 25″ and contains a denture model consisting of wax 26 and artificial teeth 27. Both halves 25′ and 25″ are filled with plaster 28 and parting surfaces 29 are provided, as known.

Figure 4:
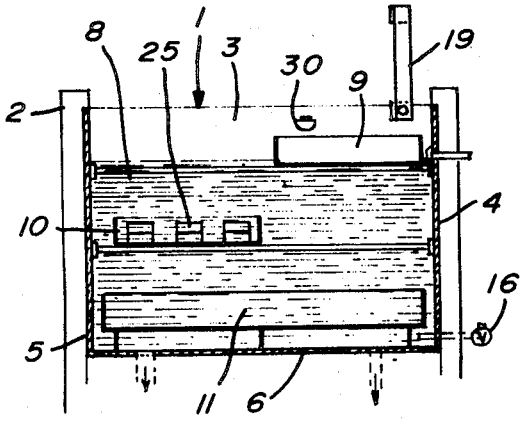

When the wax 26 has solidified and the plaster 28 has set, the dewaxing operation can be carried out: firstly, the wax must be heated to separate the flask halves. This is done by filling basin 1 with water and placing the flasks 25 on either the middle tray 10 or lowermost tray 11, as shown in FIG. 4. When wax 26 is sufficiently hot, the flask halves are separated and placed in topmost tray 9. Frame-arm 19 is then pivoted downwardly to its horizontal spray position. A contact switch 30 is provided to activate pump 23 automatically when abutted by arm 19. (cf. FIG. 5) When all traces of wax 26 have been sprayed away by nozzles 20, the flask halves are filled with plastic denture material (not shown) and reassembled for the final curing step.

Figure 6:
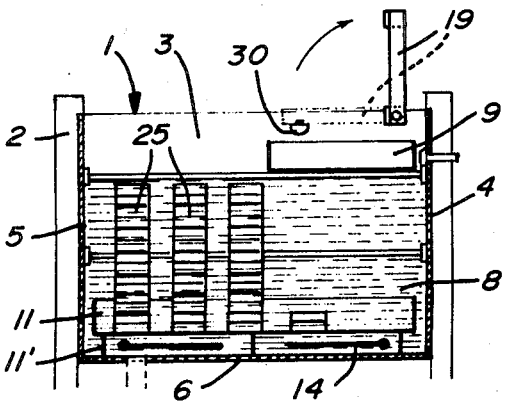
FIGS. 4 to 6 are similar cross-sectional end views of the basin, showing the first and second stages of the dewaxing step, and the final curing step, respectively.

As shown in FIG. 6, the dentures are cured under water in basin 1 for predetermined periods of time, for example one hour at 180 degrees F. and eight hours at 160 degrees F. Preferably, an automatic timer (not shown) is provided to turn on and off the heating element 14 according to desired curing periods; a thermostat (not shown) is also provided to maintain the curing temperature at constant degree.

Figure 5:
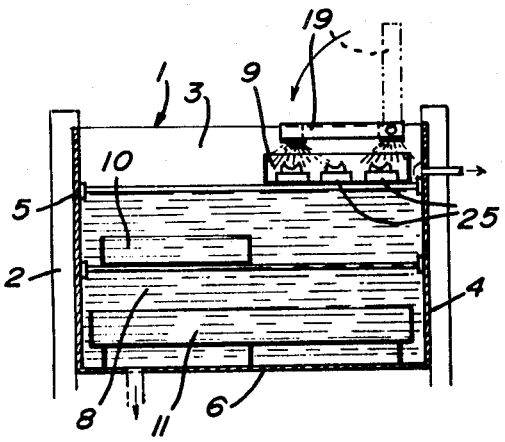

Referring finally to FIG. 5, there is shown the second stage of the dewaxing step, as mentioned above. However, it will be clear that curing, as well as dewaxing the flasks 25, can be done simultaneously: the flasks ready to be cured are placed in either the middle or lowermost trays 10 and 11 (although none are shown in the figure); the basin is filled with water 8 and heating element 14 is turned on; at the same time, flask halves, ready for final dewaxing, are placed in topmost tray 9; the frame-arm 19 is pivoted to its horizontal position, thus activating the pump 23, whereby the flask halves are sprayed clean. It will be clear as well that dewaxing and curing can be carried out in consecutive steps, if so desired.

What I claim is:

1. An apparatus for dewaxing and curing denture molds, comprising a frame and a basin mounted within said frame, said basin having a pair of spaced end walls, a rear wall, a front wall and a bottom floor wall; said basin adapted to be filled with a liquid; said basin being provided with a first topmost tray mounted on first support means in the upper portion of said basin; a second and a third, middle and lowermost, trays respectively spaced downwardly from said first tray and vertically from each other; second and third support means for said second and third trays respectively; said topmost tray being adapted to support denture flask halves for the dewaxing thereof; further comprising a frame-arm extending across the top portion of said basin and pivotally secured to the latter adjacent the upper rear edge thereof; said frame-arm being of hollow construction and provided with a plurality of shower nozzles adapted to spray liquid over the entire area of said topmost tray; said frame-arm being pivotable between a horizontal spray position and a non-use vertical position; a recirculating pump mounted in said frame and operatively connected to said frame-arm and to said basin; further comprising a heating element located adjacent said floor wall and below said lowermost tray; and a thermostat connected to said heating element to selectively control the temperature of said liquid.

2. An apparatus of the type defined in claim 1, wherein said first, second and third trays are perforated with a plurality of holes.

3. An apparatus as defined in claim 2, further including an inlet valve connected to an external liquid supply, and drain means for said basin.

4. An apparatus of the type defined in claim 1, wherein said first and second support means are lateral guideways and said first and second trays are laterally slidable thereon and removable therefrom.

5. An apparatus of the type defined in claim 4, wherein said third support means are legs at each corner of said third tray, whereby the latter is spaced above said bottom wall.

6. An apparatus of the type defined in claim 3, wherein said basin is provided with an upper and a lower liquid-level limiting means.

7. An apparatus of the type defined in claim 6, wherein said upper and lower liquid-level limiting means consist of a first and second sensor respectively, located in one end wall just under said topmost tray and just under said lowermost tray respectively; both said sensors being electrically connected to said inlet valve, whereby said inlet valve is opened when the fluid level falls to said second sensor, and shut when the fluid level reaches said first sensor.

8. An apparatus of the type defined in claim 1, wherein said heating element is electrically connected to an automatic timer.

* * * * *